US005832962A

United States Patent [19]

Kaufman et al.

[11] Patent Number: 5,832,962

[45] Date of Patent: Nov. 10, 1998

[54] SYSTEM FOR MAKING ABSORBENT PAPER PRODUCTS

[75] Inventors: Kenneth Kaufman, Mount Laurel, N.J.; Jeff Herman, Bala Cynwyd, Pa.

[73] Assignee: Kimberly-Clark Worldwide, Inc., Neenah, Wis.

[21] Appl. No.: 580,829

[22] Filed: Dec. 29, 1995

[51] Int. Cl.[6] ..... D21F 1/00; D21F 11/00

[52] U.S. Cl. ..... 139/383 A; 162/902; 442/203

[58] Field of Search ..... 139/383 A; 428/203; 162/902; 442/203

[56] References Cited

U.S. PATENT DOCUMENTS

| | | | |
|---|---|---|---|
| 3,230,136 | 1/1966 | Krake . | |
| 3,301,746 | 1/1967 | Sanford et al. . | |
| 3,905,863 | 9/1975 | Ayers . | |
| 3,974,025 | 8/1976 | Ayers . | |
| 4,157,276 | 6/1979 | Wandel et al. . | |
| 4,161,195 | 7/1979 | Khan . | |
| 4,191,609 | 3/1980 | Trokhan . | |
| 4,239,065 | 12/1980 | Trokhan . | |
| 4,518,644 | 5/1985 | Vuorio . | |
| 4,528,239 | 7/1985 | Trokhan . | |
| 4,529,480 | 7/1985 | Trokhan . | |
| 4,637,859 | 1/1987 | Trokhan . | |
| 5,025,839 | 6/1991 | Wright | 139/383 A |
| 5,089,324 | 2/1992 | Jackson | 139/383 A |
| 5,169,709 | 12/1992 | Fleischer | 139/383 A |
| 5,211,815 | 5/1993 | Ramasubramanian et al. | 139/383 A |
| 5,297,590 | 3/1994 | Fleischer | 139/383 A |
| 5,429,686 | 7/1995 | Chiu et al. | 139/383 A |
| 5,456,293 | 10/1995 | Ostermayer et al. | 139/383 A |
| 5,542,455 | 8/1996 | Ostermayer et al. | 139/383 A |

FOREIGN PATENT DOCUMENTS 0 008 180 A1 2/1980 European Pat. Off. .

*Primary Examiner*—Andy Falik
*Attorney, Agent, or Firm*—Gregory E. Croft

[57] ABSTRACT

A papermaking fabric, particularly useful as a throughdrying fabric, which has shute and warp threads woven together to define a top surface plane on the sheet side containing only a number of relatively long warp knuckles at locations where one of the warp threads crosses over at least four of the shute threads. The long warp knuckles are positioned in a shed pattern to form (a) a first axis of bulky ridges that are defined by long warp knuckles positioned next to each other on adjacent warp threads, the first axis being disposed at a first angle with respect to the cross-direction of the drying fabric that is substantially between 68 and 90 degrees; and (b) a second axis formed by each of the long warp knuckles with other, overlapping long warp knuckles on nearby, but not immediately adjacent, warp threads, the second axis forming a second angle with respect to the cross-direction of the drying fabric of less than about 28 degrees.

31 Claims, 12 Drawing Sheets

SYSTEM FOR MAKING ABSORBENT PAPER PRODUCTS

BACKGROUND OF THE INVENTION

1. Field of the Invention

This invention relates, broadly speaking, to the field of absorbent consumer paper products, such as towels, wipes and toilet tissue. More specifically, this invention relates to an improved drying fabric for making absorbent paper products, to the system and method of making such products, and to the product itself. This fabric design also lends itself to forming and transfer fabric applications, which may be used for making absorbent or flat grade papers.

2. Description of the Prior Art

In all paper machines, paper stock is fed onto a traveling endless belt that is supported and driven by rolls associated with the machine and which serves as the papermaking surface of the machine. In one common type of paper machine, two types of belts are used: one or more "forming" fabrics that receive the wet paper stock from the headbox or headboxes, and a "dryer" fabric that receives the web from the forming fabric and moves the web through one or more drying stations, which may be through dryers, can dryers, capillary dewatering dryers or the like. Forming, transfer, or drying belts can be formed from a length of woven fabric with its ends joined together in a seam to provide an endless belt. Fabrics can be woven endless depending on the running length of the fabric. Fabrics for this purpose generally include a plurality of spaced longitudinal warp filaments that are oriented in a machine direction ("MD") of the paper machine, and a plurality of shute (also called "weft" or "woof") filaments, oriented in a cross direction ("CD") that is orthogonal to the MD direction. The warp and shute filaments are woven together in a predetermined weave pattern that results in a distinctive pattern of "knuckles" or raised crossover locations on the fabric where a warp filament crosses over a shute filament, or vice versa. Such knuckles, when on the side of the fabric that contacts the paper web, whether it be a forming fabric, transfer, or a drying fabric, impart a depression or compressed area onto the paper web. The pattern of those depressions have a great deal to do with the texture of the finished product, irrespective of whether additional processing steps such as creping or calendaring are performed on the web.

A great deal of study has gone into developing complex fabrics for paper machines in order to provide product that is textured in a way that will be well received by consumers. For example, U.S. Pat. Nos. 3,905,863 and 3,974,025 to Ayers disclose a paper sheet and process for making it in which the back side of a semi-twill fabric is imprinted on the sheet. The sheet has a diamond-shaped pattern imprinted on it and after creping, lofted areas align in the cross direction of the sheet. Only three-shed (meaning that the crossover pattern of each warp filament will repeat every three shute crossovers) fabrics are used, which have both machine direction warp and cross direction shute knuckles in the top surface plane on the sheet side of the fabric.

U.S. Pat. No. 3,301,746 to Sanford discloses a process using imprinted fabrics that may be of a square or diagonal weave, as well as twilled or semi-twilled fabrics. The fabrics are coplanar. The product is characterized by alternately spaced, unbroken ridges of uncompressed fibers and troughs of compressed fibers, which extend in the cross machine direction. U.S. Pat. No. 4,157,276 to Wandel et al. discloses a wet end papermaking fabric of at least a five-shed, and preferably a broken twill, in an "Atlas" binding with the shute counts at least 80% of the warp counts. The warp and shute knuckles are also coplanar in the top surface plane on the sheet side, The atlas binding generally has the warp going under 1 shute and over (n−1) shutes in an n shed repeat on the sheet side.

U.S. Pat. No. 4,161,195 to Khan refers to a paper forming fabric and to the weaves themselves, which are 5-shed or greater and are woven in a non-regular twill pattern such that threads in both the MD and CD have interlacings in each weave repeat so as to be to be "evensided" and such that no MD or CD knuckle exceeds more than three crossovers in length. Generally the MD and CD knuckles on the sheet side of the fabric are coplanar in the top surface plane, although this is not a requirement. The patent refers to the above designs as "Granite" patterns. The fabric has relatively short MD knuckles, no more than 3 crossovers, even-sided fabrics, and little overlap of MD knuckles.

Trokhan, U.S. Pat. No. 4,191,609, refers to a soft imprinted paper sheet that is characterized by a patterned array of relatively closely spaced uncompressed pillow-like zones each circumscribed by a picket-like lineament comprising alternatively spaced areas of compacted and non-compacted fibers. The pillow like zones are staggered to both the MD and CD directions. The picket-like lineaments are produced by the MD and CD knuckles in the top-surface plane on the sheet side of the imprinting fabric. Trokan U.S. Pat. No. 4,239,065 refers to related paper making clothing.

Trokhan U.S. Pat. Nos. 4,528,239, 4,529,480 and 4,637,859 refer to a soft, absorbent paper web, the process for making the webs, and the foraminous fabric (or deflection member) used as an imprint/drying fabric in the process. The paper web is characterized by a relatively dense monoplanar, patterned, continuous network of compressed fibers and a plurality of relatively low density domes composed of uncompressed fibers. Each low density dome is completely encompassed and isolated by the network of compressed fibers; the domes are also staggered with respect to both the MD and CD directions. The fabric—or foraminous deflection member—is composed of a woven base on its wear side and a monoplanar, continuous network surface formed by a photosensitive resin on its sheet side.

The fabrics discussed above and the products made therefrom have proven relatively successful. However, the industry continues to strive for fabrics, processes and products that are superior in such ways as manufacturing efficiency, speed, and reliability, and in terms of product bulk, strength, texture and handfeel. This invention provides a significant advance in all of those areas.

SUMMARY OF THE INVENTION

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

The preferred embodiment of the invention involves the use of a high shed, complex woven fabric in the forming, transfer and\or drying positions of a papermaking system to make a soft absorbent paper product such as tissue and towel. The distinct product is of a better quality (higher bulk, TWA, softness, CDS) than that made with conventionally woven through-dryer ("TD") fabrics. Use of the high shed, complex woven fabric as a TD fabric also results in the expenditure of less energy to dry the paper sheet and better release of the paper sheet from the TD fabric. It also presents the possibility of increasing the sanded knuckle area on the sheet side of the TD fabric to increase sheet tension after the creping step at high speeds, without losing product bulk. The invention embraces the distinct tissue product, the process for making it, and the complex woven fabric itself.

Figure 1:
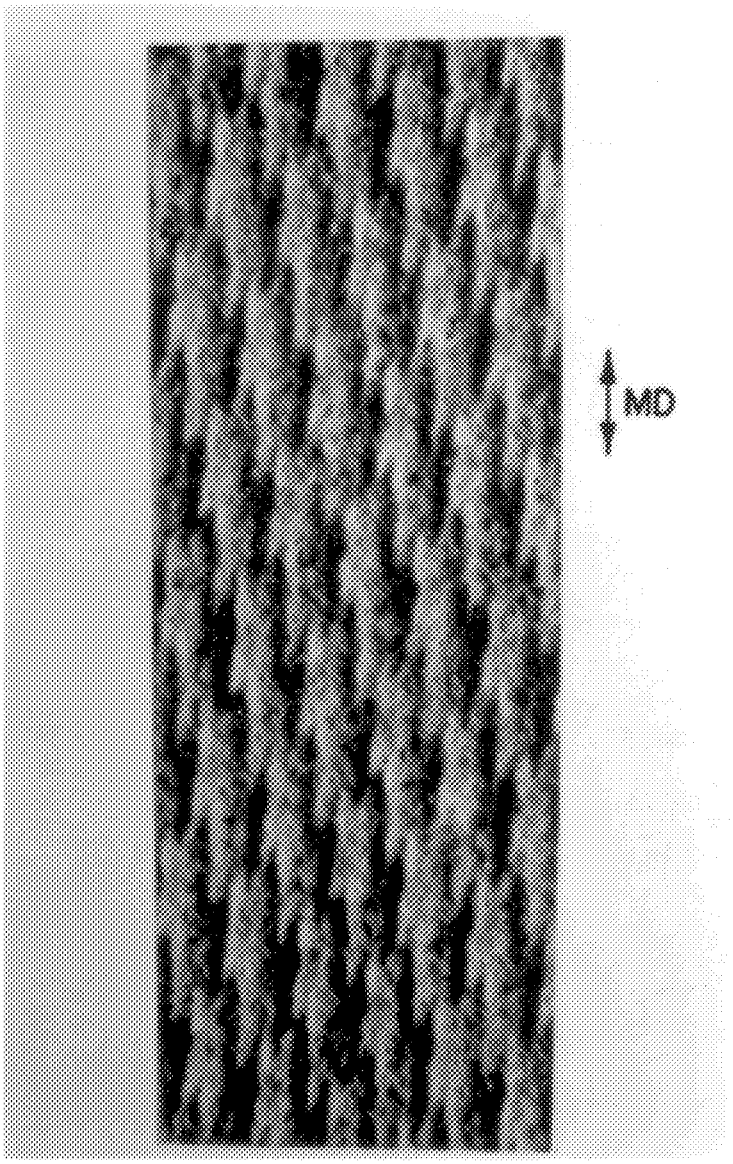
FIG. 1 is a photograph depicting the fabric side, also referred to as the air side, of an uncreped absorbent web that is fabricated according to a preferred embodiment of the invention.

Referring now to FIG. 1, which is a photograph depicting the TD fabric side or air side of an uncreped absorbent paper sheet made according to the preferred method of the invention, it will be seen that the high bulk absorbent paper product is characterized on its air side by essentially continuous, low density ridges of substantially uncompressed fibers running parallel to one another and at an angle to both the machine direction ("MD") and cross direction ("CD") of the product. The ridges are bounded or defined by an angular pattern of long, overlapping, discrete, MD oriented, oblong areas of highly compressed, dense fibers. As will be described more fully below, the dense areas correspond to the MD (or long warp) knuckles in the sheet side of the TD fabric, while the low density ridges correspond to the continuous channels woven into the fabric. For a typical TD fabric with mesh count of 44×38 and yarn diameters of 0.35 mm and 0.40 mm, the ridges are about 0.054" wide and about 0.068" from each other, centerline to centerline. Ridge widths for other expected mesh and diameters for TD and forming fabrics are shown in the table below:

| Mesh Count | Yarn Diam | Ridge Width | CL to CL |
|---|---|---|---|
| 24 × 24 | 0.40 mm | 0.1489" | 0.1667" |
| 180 × 180 | 0.12 mm | 0.0147" | 0.0160" |

Each ridge extends along or parallel to a first axis that is disposed at a first angle with respect to the cross-direction of the paper product. Preferably, the first angle is substantially within the range of greater than 68 degrees but less than 90 degrees, with a more preferred range of 70–90 degrees. The product is also characterized by second parallel axes formed by each of the oblong areas with other, overlapping oblong areas not adjacent to a same side of a same bulky ridge. The second axes form a second angle with respect to the cross-direction of the paper product, which is preferably less than about 28 degrees and more preferably less than about 25 degrees. The oblong areas along the second axis overlap by at least 60 percent, and by at least 0.035 inches. The oblong areas reside in a plane that is depressed with respect to the ridges by at least 0.005 inches.

Figure 2:
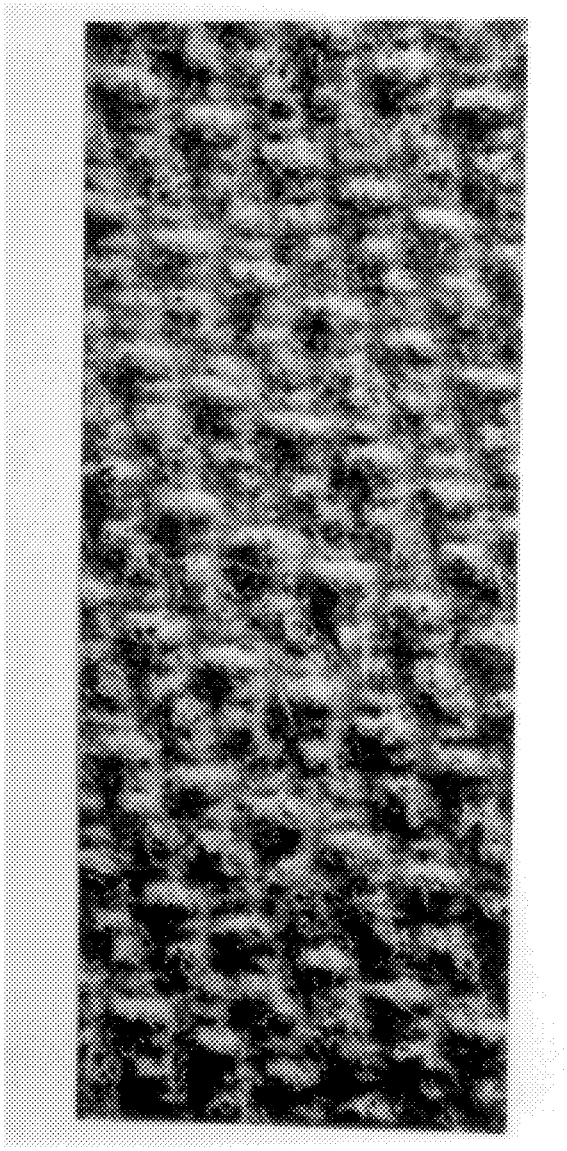
FIG. 2 is a photograph depicting the fabric side, also referred to as the air side, of an creped absorbent web that is fabricated according to a preferred embodiment of the invention.

Referring now to FIG. 2, which is a photograph depicting the TD fabric side of an creped absorbent paper sheet made according to the preferred method of the invention, it will be seen that the high bulk absorbent paper product is characterized on its air side by essentially continuous, low density ridges of substantially uncompressed fibers running parallel to one another and at an angle to both the machine direction ("MD") and cross direction ("CD") of the product. The creping process tends to foreshorten the sheet by the amounts of speed differential between the Yankee dryer and the reel. The crepe "C" is defined by:

$$C=(Y-R)/R$$

(where C=crepe, Y=Yankee speed, and R=Reel speed)

Creping the sheet will change the preferred angles 1 and 2 on the uncreped sheet. The amount change depends on the crepe level. The foreshortened angle can be calculated as follows:

$$\text{Angle } 1_c=\tan^{-1}\{(1/(1+C))\times\tan \text{ Angle } 1_u\}$$

$$\text{Angle } 2_c=\tan^{-1}\{(1/(1+C))\times\tan \text{ Angle } 2_u\}$$

(where Angle $1_c$=Angle 1 of the creped sheet, Angle $2_c$=Angle 2 of the creped sheet, Angle $1_u$=Angle 1 of the uncreped sheet, and Angle $2_u$=Angle 2 of the uncreped sheet)

Thus, at 12% crepe, the preferred range for Angle $1_c$ on the creped sheet is 68° to 90° and Angle $2_c$ must be less than 25°. As may also be seen in the photograph that is provided in FIG. 2, the bulky ridges have periodic indentations therein that do not substantially compress the fibers of said web, whereby the product is prevented from having an undesirable twill-like appearance.

Figure 3:
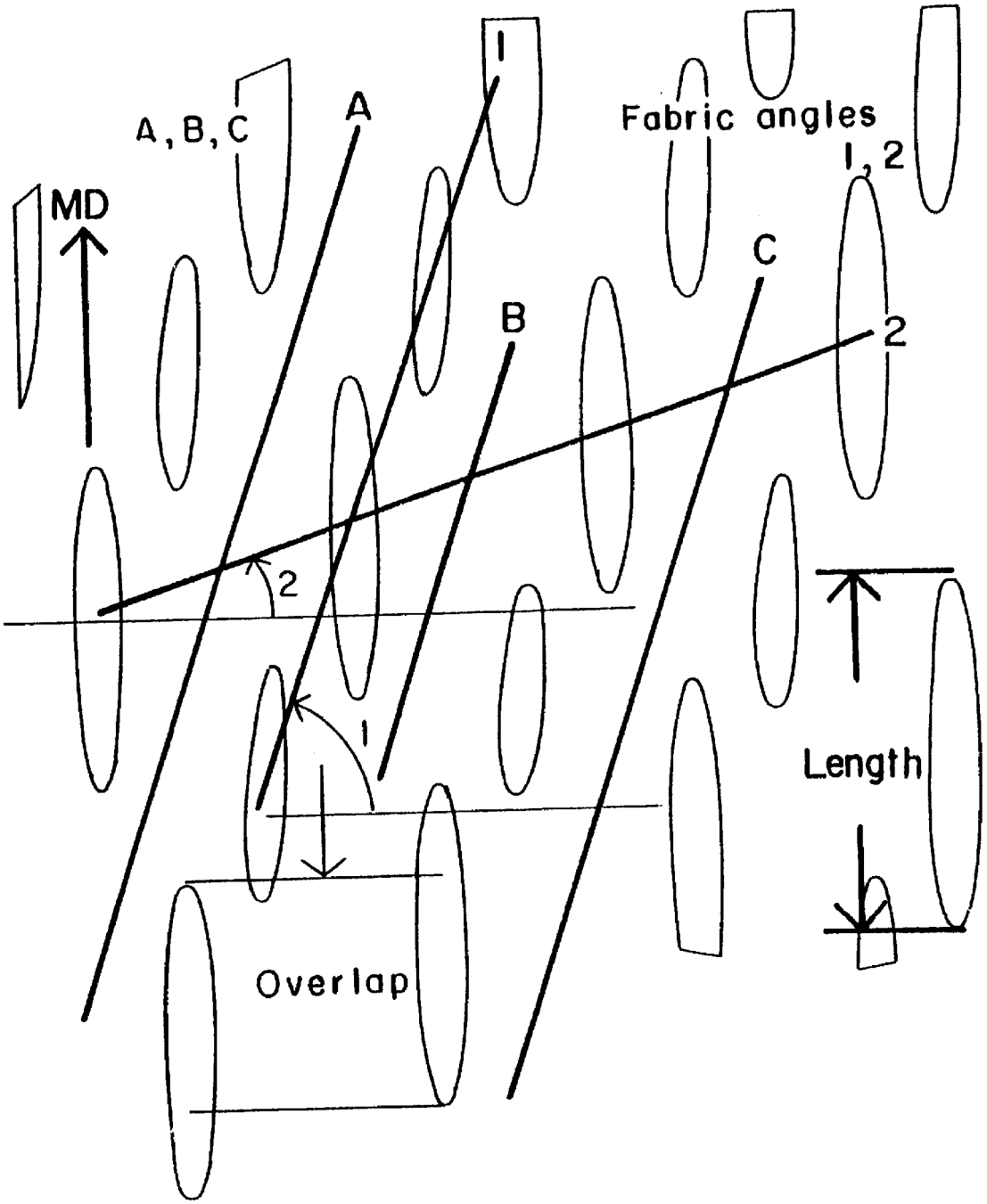
FIG. 3 is a diagrammatical depiction of a knuckle pattern in the top plane of a thirteen shed fabric that represents a preferred embodiment of the fabric aspect of the invention.
Figure 4:
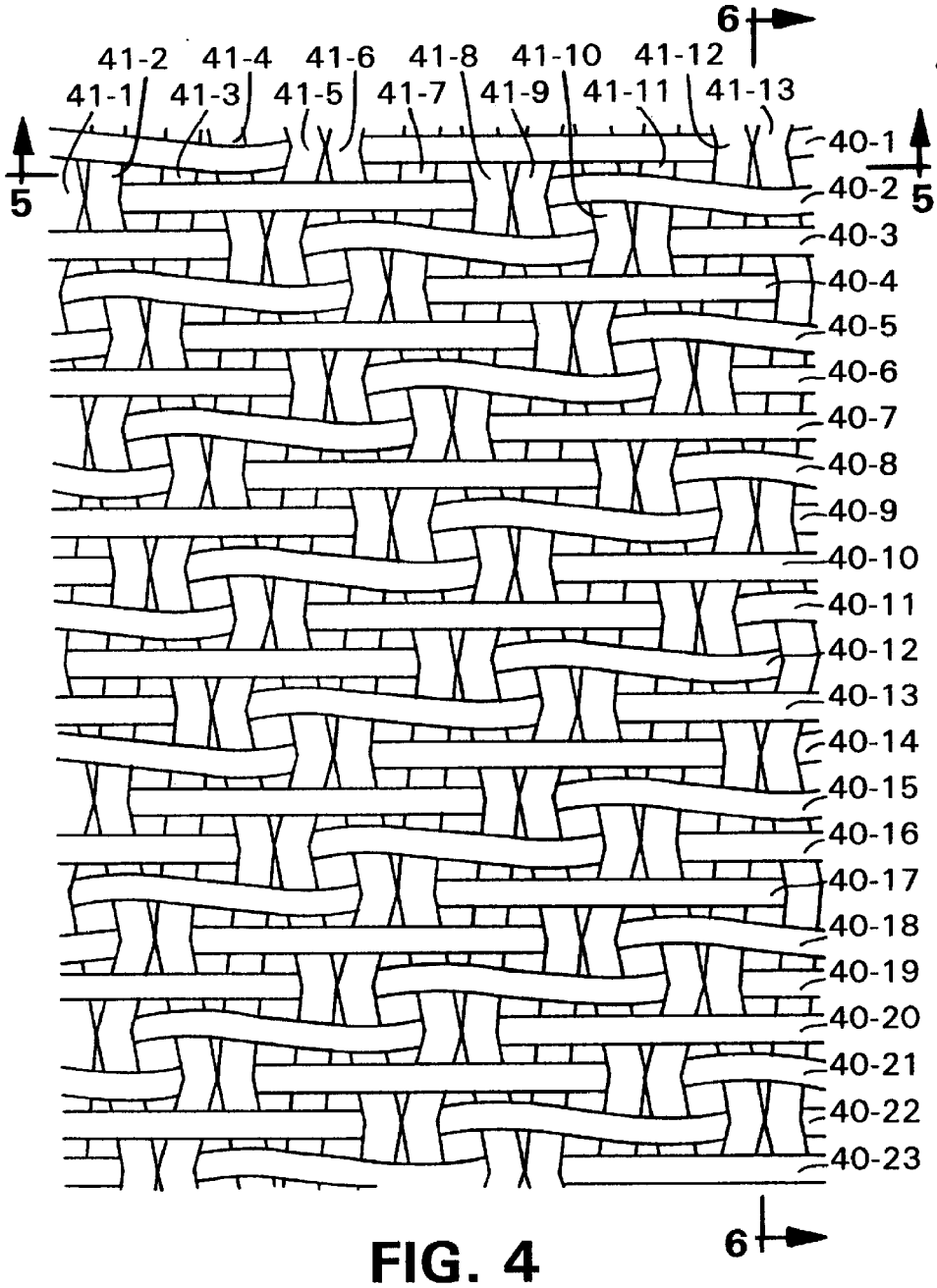
FIG. 4 is a diagrammatical depiction of the weave pattern in the fabric shown in FIG. 3.

FIG. 3 is a diagrammatical depiction of the fabric weave pattern in which only the long warp knuckles of a fabric according to the invention reside in a top plane of the fabric that will correspond to the deepest penetration of the fabric into the absorbent paper product during formation or drying. These knuckles then produce the oblong compressed areas in the paper. The long or raised MD oriented warp knuckles have been sanded to provide a flat surface in the top plane of the fabric. FIG. 4 depicts the fabric itself, according to the preferred embodiment of the invention.

As may be seen in FIGS. 3 and 4, the fabric includes a plurality of shute threads that extend substantially parallel to each other in a cross-direction of the drying fabric, and a plurality of warp threads extending substantially parallel to each other in a machine direction of the drying fabric. The shute and warp threads are woven together so as to define a number of relatively long warp knuckles at locations where one of the warp threads crosses over at least four of the shute threads. In correspondence with the pattern and angles on the absorbent paper product that are discussed above, the long warp knuckles are disposed in a pattern so as to form a group of first parallel axes of bulky ridges that are defined by long warp knuckles which are positioned next to each other on adjacent warp threads. The first axes are disposed at a first angle with respect to the cross-direction of the drying fabric, which is substantially within the range of greater than 68 degrees but less than 90 degrees. The long warp knuckles of the fabric also form second parallel axes that are defined by each of the long warp knuckles with other, overlapping long warp knuckles on nearby, but not immediately adjacent, warp threads. The second axes form a second angle with respect to the cross-direction of the drying fabric, which is less than about 28 degrees. The complex fabric has only long, MD knuckles in the top surface plane on the sheet side of the fabric: no CD knuckles are present. Typically,,there is a 0.008"–0.010" difference in depth between the top plane MD knuckles and the closest CD knuckle crossover before surfacing. (It is noted that Khan, U.S. Pat. No. 4,161,195, defines "coplanar" as being within 0.0005") The length of these long warp knuckles ("LWK") will depend on the exact weave, mesh count, yarn size, and the amount of sanding but will always be longer than 0.060" for a TD fabric. The overlap of the LWK should be maximized to obtain the greatest benefit from the invention. Overlap is a function of the knuckle length and angles and can be expressed as a percentage of knuckle length (ie, 100% represents overlap equal to the length of the knuckle or two parallel knuckles of equal length, and 0% represents no overlap or two knuckles out of phase with one another). The second angle defined above most determines the amount of overlap. In the preferred embodiment of the invention for TD fabrics, each long warp knuckle overlaps adjacent long warp knuckles along the second axis by at least 60 percent and by at least 0.035 inches. The second angle must be kept as low as possible to maximize overlap. In FIG. 3, LWK length is 0.100", overlap is approximately 70%, the first angle is about 72.8° and the second angle is about 23.3°. Preferably, all four measurements are within the specified ranges to produce the paper property benefits of the invention. All four measurements are a function of weave sequence, yarn diameter, and mesh count.

A few examples of fabrics that meet these criteria are listed below:

| Fabric # | Mesh Count | Yarn Size | Knuckle Length | Knuckle Overlap | Angle 1 | Angle 2 |
|---|---|---|---|---|---|---|
| 1 | 44 × 36 | 0.35 mm × 0.40 mm | 0.120" | 75% | 73.9° | 16.1° |
| 2 | 44 × 34 | 0.35 mm × 0.45 mm | 0.090" | 69% | 72.8° | 23.3° |
| 3 | 44 × 38 | 0.35 mm × 0.40 mm | 0.100" | 70% | 70.9° | 21.1° |
| 4 | 44 × 38 | 0.35 mm × 0.40 mm | 0.090" | 67% | 77.8° | 24.9° |

The inventors have found that such a fabric will impart improved sensory, aesthetic and crepeability characteristics to an absorbent paper web that is dried thereon.

The inventors have also determined that the best product characteristics will be achieved when the warp and shute threads are woven in a shed count that is at least nine. To achieve the desired paper characteristics, in at least one section of the repeat pattern the LWK should span at least 4 CD crossovers. Preferred embodiments have the LWK span at least 4 CD crossovers in two sections within the MD repeat. The pattern repeat must also be such that the MD warp yarn has at least 4 interlacings with CD yarns in a pattern repeat; even more interlacings (5 or 6) are preferred to get better fabric stability.

Both fabric stability and the difference in height between the top surface warp knuckles and below top surface plane shute knuckles on the-sheet side are facilitated by weave designs which generate lateral crimp in the CD shute yarns. Lateral crimp is defined as a condition where the yarns travel side to side as well as up and down within the fabric weave. Within the series of fabric designs discussed, lateral crimp occurs when two adjacent yarns (2 warps or 2 shutes) traveling in opposite directions (ie one traveling down and the other traveling up) come between two adjacent yarns (2 shute or 2 warp) traveling 90° from the direction of the first two yarns. Lateral crimp can also be augmented by having the warp yarn pass over or under multiple shute yarns. These resulting designs are not "even sided," as is that disclosed in U.S. Pat. No. 4,161,195 to Khan, i.e. the number of crossovers by the warp yarns over the shute yarns on one side of the fabric is not the same, or within 1, of the number of crossovers on the other side of the fabric. As is seen in the examples below, fabrics according to this invention are decidedly not even-sided.

Lateral crimp may be facilatated through varying the fabric break among other parameters. The break refers to the number of CD yarns which are skipped on any two adjacent MD yarn before the next pattern repeat begins. Break is a function of the shed of the fabric. A 5-shed weave has 4 possible fabric breaks, 1, 2, 3, & 4. Breaks 1 and 4 are identical but are mirrored images of one another. Breaks 2 and 3 are identical but are mirrored images of one another. Therefore, with a 5-shed weave, there are only 2 unique breaks. The higher the shed, the more unique break options. A "n" shed fabric, where "n" equals a prime number, will yield n−1 possible break options, with (n−1)/2 being unique. When lateral crimp occurs in one of the yarns the fabric structure changes such that either warps or shutes will be out-of-plane with one another. The amount of planar difference between warp and shute has also been shown to be a function of mesh count, yarn diameter, and techniques of manufacture such as the heat setting process. The current invention uses the higher shed fabrics to generate break patterns that bring only LWK in the top plane of the fabric, thus, creating the channels in which low densification in the paper occurs. Fabrics of the invention are woven with "breaks" of 3 or preferably 4 or higher.

Figure 5:
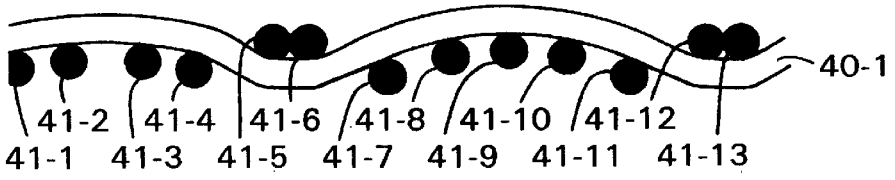
FIG. 5 is a diagrammatical depiction of the warp contour in the embodiment of FIGS. 3 and 4.

In the preferred embodiment shown in FIG. 4, the warp and shute threads are woven in a shed count of thirteen, and more specifically, as is illustrated diagrammatically in FIG. 5, in a warp pattern of five over, two under, (Warp threads are identified by reference numbers 40-1 through 40-23 and shute threads are identified by reference numbers 41-1 through 41-13). four over and two under. With this pattern, not only are the warp and shute knuckles out of plane, but also, the two long warps are out of plane and require sanding to bring both in the top plan surface. The break for this fabric is 4. This break in pattern also helps sheet appearance and minimizes marking, since the resulting weave then simulates a "broken twill" pattern. (A regular twill pattern is one which has a succession of adjacent yarns that present on a fabric face equal length knuckles comprised of two or more crossovers in which each successive yarn advances its weave repeat by one crossover from the preceding yarn, to form the characteristic diagonal line.) The complex woven fabrics of this invention have a combination of desired characteristics: only LWKs in the top surface plane on the sheet side (Angle 1>68°); LWK be at least 0.060" long; optimum overlap (Greater than 60%) of the MD knuckles to produce continuous channels (Angle 2<28°; at least one LWK spanning 4 or more crossovers in a pattern repeat; at least 3 MD interlacings of the MD warp with the CD yarns in a pattern repeat; lateral crimp in CD yarns; no "even-sidedness"; breaks of at least 3. When woven in this manner, the fabrics have numerous sub-top-surface plane crossovers of warps and shutes which form the bottom of the continuous channels and thus support the top of the ridges on the tissue sheet. These sub surface crossovers also give the ridges the indentations discussed earlier, since they are of varying depths below the top-surface plane.

The complex fabrics can be woven and heat set for good stability and elongation characteristics. Yarn sizes can be in the range of 0.22 to 0.50 mm including the same as those currently used on existing 4 or 5 shed fabrics (eg 0.35 mm warp, 0.40 mm shute); thus wear characteristics and fabric life can be very good. Yarn material types can be polyester, polyamide, polypropopylene, PTFE, ryton, PEEK, etc. Yarns can have a round, ovel, or flat (retangular) shape.

Thirteen shed fabrics (ie the MD pattern repeats every 13 CD yarns) lend themselves to weaves of this invention and are the preferred shed count; they are particularly good for seaming. Shed counts of at least 9 are required to obtain the desired fabric characteristics noted above.

Figure 6:
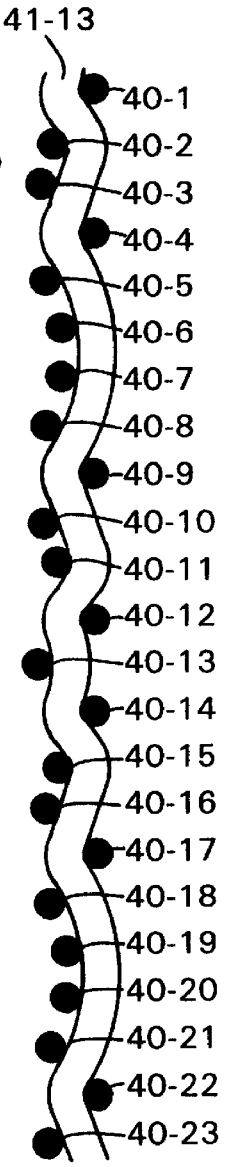
FIG. 6 is a diagrammatical depiction of shute contour in the embodiment of FIGS. 3 and 4.

Again, the fabric of FIG. 5 has a warp pattern of 5×2×4×2 (5 over, 2 under, 4 over, 2 under); the break is 4. Warp yarns of 0.35 mm diameter and 0.45 mm shute diameter were used. The top-surface plane on the sheet side has warp knuckles at least 0.090" long; there are no shute knuckles. Knuckle overlap is 69% while the first angle is 72.8° and the second angle 2 is 23.3°. The design has a break of 4. In each MD pattern repeat, the warp yarn spans first 5 CD yarn crossovers and then 4 CD yarn crossovers; it thus interlaces with 4 CD yarns, as may be seen in FIG. 5. The resulting design is not evensided, i.e. the MD yarn crosses 9 CD yarns on the sheet side and only 4 CD yarns on the other (roll) side of the fabric. As is shown diagrammatically in FIG. 6, the CD yarn repeats in a pattern that is 4×1×2×1×1×1×2×1 (4 under, 1 over, 2 under, 1 over, 1 under, 1 over, 2 under, and 1 over). This weave pattern produces significant lateral crimp in the CD yarns, which helps to keep the shute yarns below the top surface plane on the sheet side. The difference in height between the top surface plane unsanded MD knuckles and the next closest CD crossover knuckle is about 0.004" below the top surface plane for the example shown.

Figure 7:
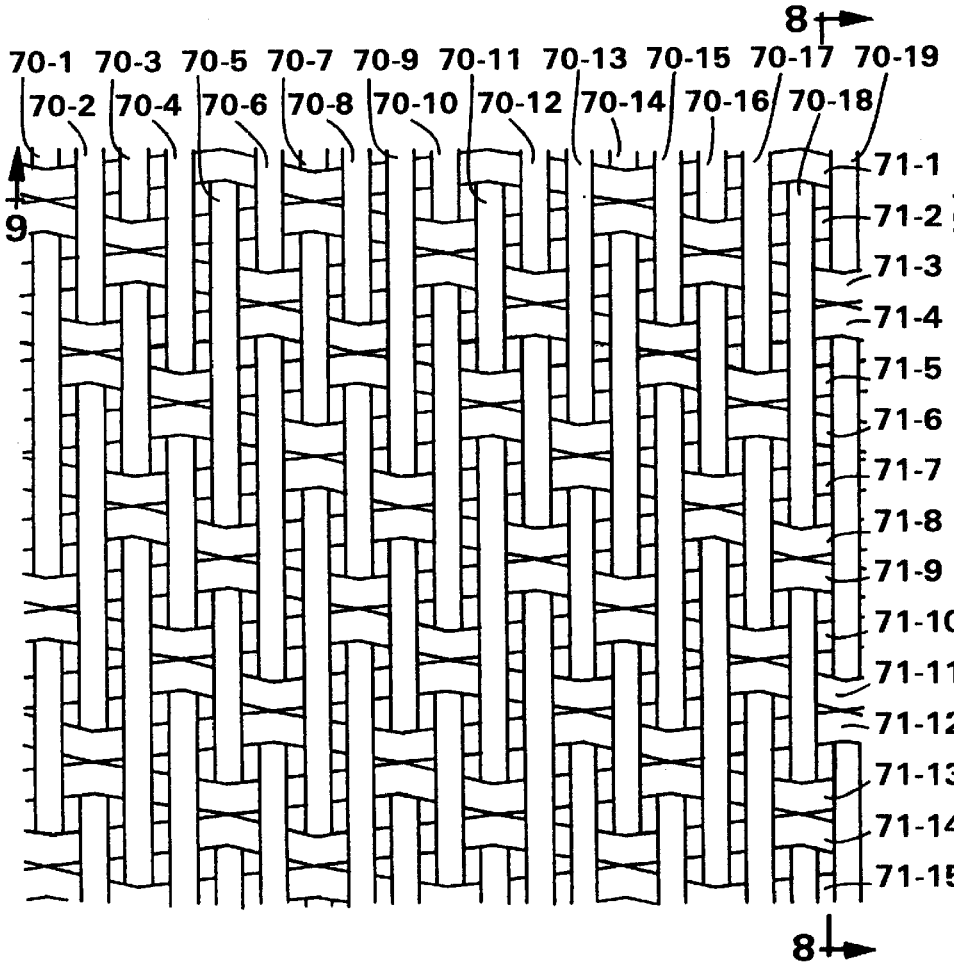
FIG. 7 is a diagrammatical depiction of an alternative preferred weave pattern to that shown in FIG. 4.
Figure 8:
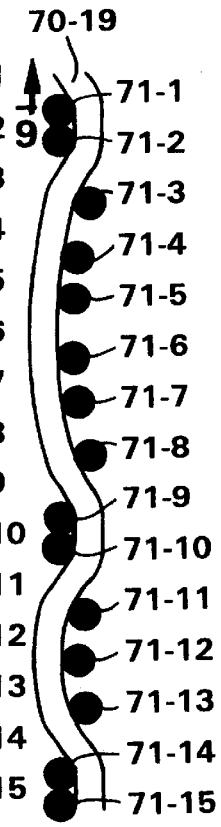
FIG. 8 is a diagrammatical depiction of the warp contour in the embodiment of FIG. 7.
Figure 9:
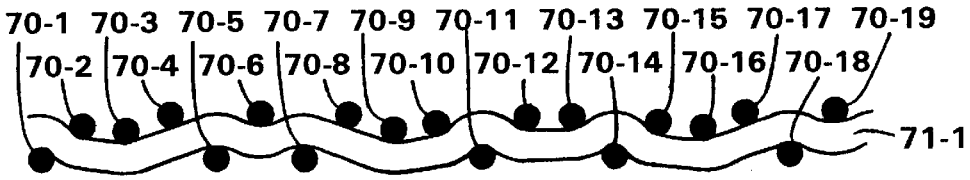
FIG. 9 is a diagrammatical depiction of the shute contour in the embodiment of FIG. 7.

Another example of a 13 shed is seen in FIG. 7. (Warp threads are identified by reference numbers 70-1 through 70-19 and shute threads are identified by reference numbers 71-1 through 71-15). For this weave the warp repeat is 6×2×3×2 (over 6, under 2, over 3, under 2). The fabric break is 3 and the yarn size is 0.35 mm warp and 0.40 mm shute. The warp/shute count is 44/38. The LWK length is 0.120", overlap is 75° (0.090"), the first angle is 73.9° and the second angle is 16.1°. The channels obtained with this fabric are very large and tend to be supported by an intermediate relatively short warp knuckle giving the ridges on the paper a "chain-link" fence, dimpled, or "bagel" like appearance. The warp and shute repeat patterns for this embodiment are shown in FIGS. 8 and 9. Either of these warp patterns, as well as others that will be apparent to those having ordinary skill in this area of technology, will be effective, as long as, within one MD repeat, one of the warp threads crosses over at least four of the shute threads to form a long warp knuckle of the type shown in FIGS. 3. Preferably, the warp and shute threads are woven so as to create lateral crimp in the shute threads.

Higher sheds than 13 are acceptable and may be found to be advantageous.

In some forming and drying applications, the weaves discussed above may be rotated 90° so that the Long Warp Knuckle becomes a Long Shute Knuckle; there are then no warp knuckles in the top plane of the fabric. These type of rotated fabric weaves may be desirable in some forming applications or particular drying applications, e.g. where the tissue paper is dried without creping.

In drying and transfer applications mesh counts will typically be from 10×10 to about 60×60. Forming applications would tend to have finer meshes, probably up to about 120×120 counts.

Previously known weaves can not produce the results and advantages that inhere to the invention. "Satin" and "Atlas" weaves (1 under×(n−1) over on sheet side with the opposite on the other side, as disclosed in the Wandel patent can produce long MD knuckles but tend to have warp and shute knuckles in the top-surface plane on the sheet side (i.e. "coplanar") and don't give lateral crimp; thus, they do not have the parallel continuous channels required by the invention. They also do not meet the angle specifications and number of interlacings required by the invention to achieve its objectives. The "Granite" patterns of Khan are even sided, have relatively short MD knuckles (no more than 3 MD crossovers), and fall outside the criteria of this invention noted above. They may also have coplanar warp and shute knuckles on the top-surface plane on the sheet side.

Figure 10:
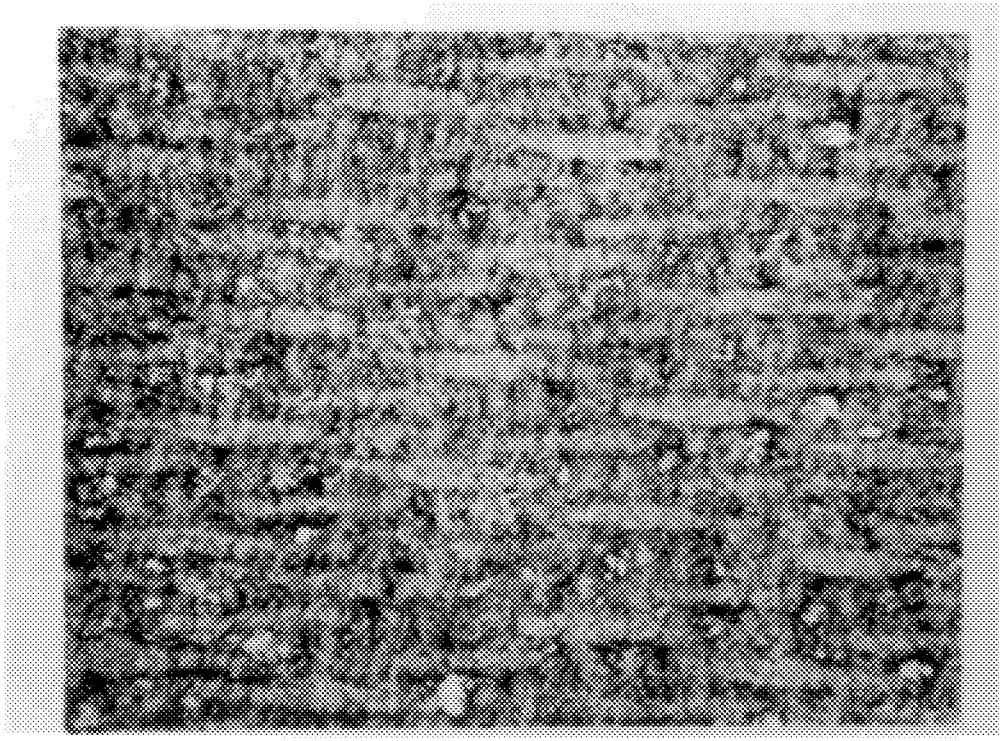
FIG. 10 is a photograph that is a lite transmission photo of creped product according to the invention.

As may be seen in FIG. 10, which is a light transmission photo of creped tissue made according to the invention, the light oval shaped objects are areas of compressed fibers that tend to be relatively dense and are generated by the MD knuckles of the TD fabric. The dark areas are the ridges of relatively uncompressed fiber which were nestled in the channels of the complex woven drying fabric during the drying and pressing steps. In this example, the uncompressed ridges run at an angle of about 70.9° to the CD, which is the first angle as defined above, and are about 0.054" wide, and about 0.068" from each other, centerline to centerline. The second angle, as defined above, is about 21.1° from the CD. Angle 1 of the uncreped sheet was 72.8°, and Angle 2 was 23.3°.

Figure 11:
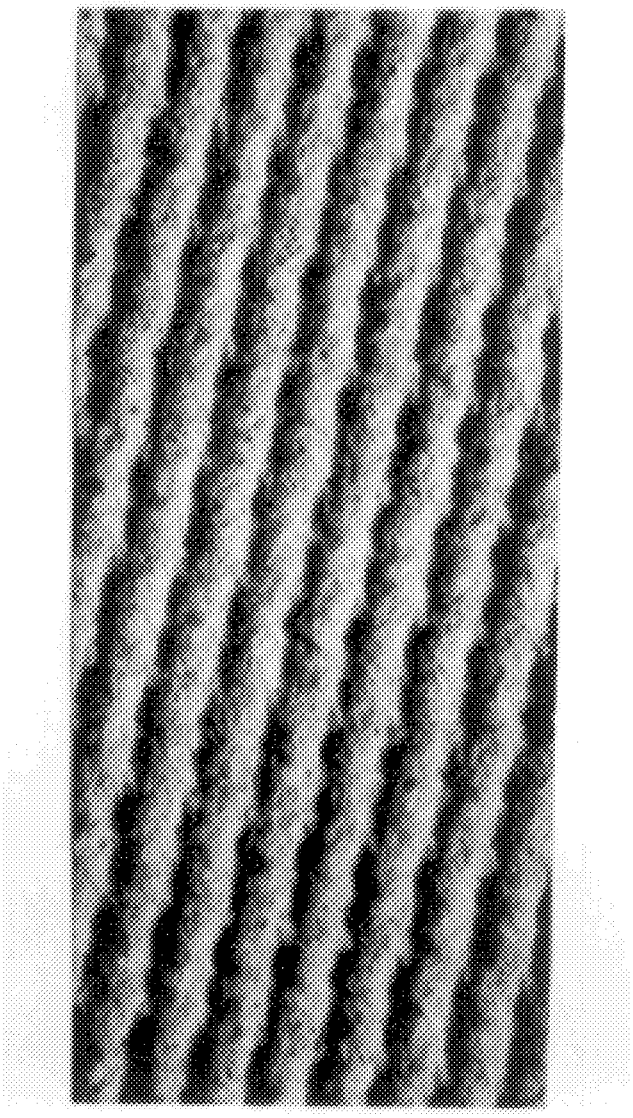
FIG. 11 is yet another example of the bulky ridges produced from yet another alternative preferred shed pattern, shown on the fabric or air side of an uncreped towel.

The continuous ridges of uncompressed fiber characteristic of this soft, absorbent tissue are not of uniform height. They have occasional indentations caused by the sub-surface crossovers of warp and shute strands on the sheet side of the complex woven fabric. As may be seen in FIG. 2, these indentations help to stabilize the ridge areas and, more importantly, improve the aesthetics of the sheet by giving the surface a more topographical, 3-dimensional appearance. By breaking up the appearance of parallel continuous rows, the undesirable "twill" pattern look associated with many fabric pattern markings is avoided. The indentations do not substantially compress the fibers; thus the indented areas are still of a relatively low density, as can be seen in the FIG. 2. Depending on the specific weave, mesh count, and yarn diameter of the fabrics of this invention, the sheet appearance may range from distinct, parallel ridges (a twill look) to almost a random pebble pattern (a terri-cloth look). FIG. 11 shows yet another product variant demonstrating the concept of parallel ridges. In this example, the photo depicts the TD fabric side of uncreped towel web made using yet another TD fabric weave that meets the criteria of this invention. Clearly visible are such parallel ridges. For this weave, the warp repeat is 7×1×1×1×2×1 (over 7, under 1, over 1, under 1, over 2, under 1). The fabric break is 4 and the yarn size is 0.35 mm warp and 0.40 mm shute. The warp/shute count is 44×38.

Figure 12:
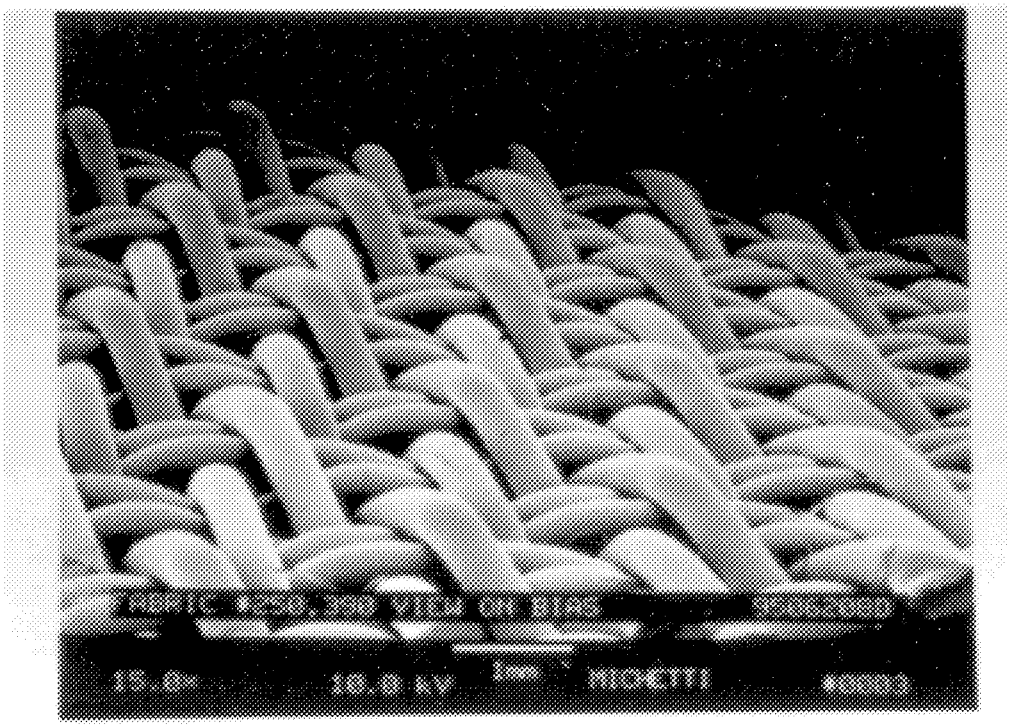
FIG. 12 is photograph taken of the fabric shown in FIG. 4 along the axis which creates the bulk ridges.
Figure 13:
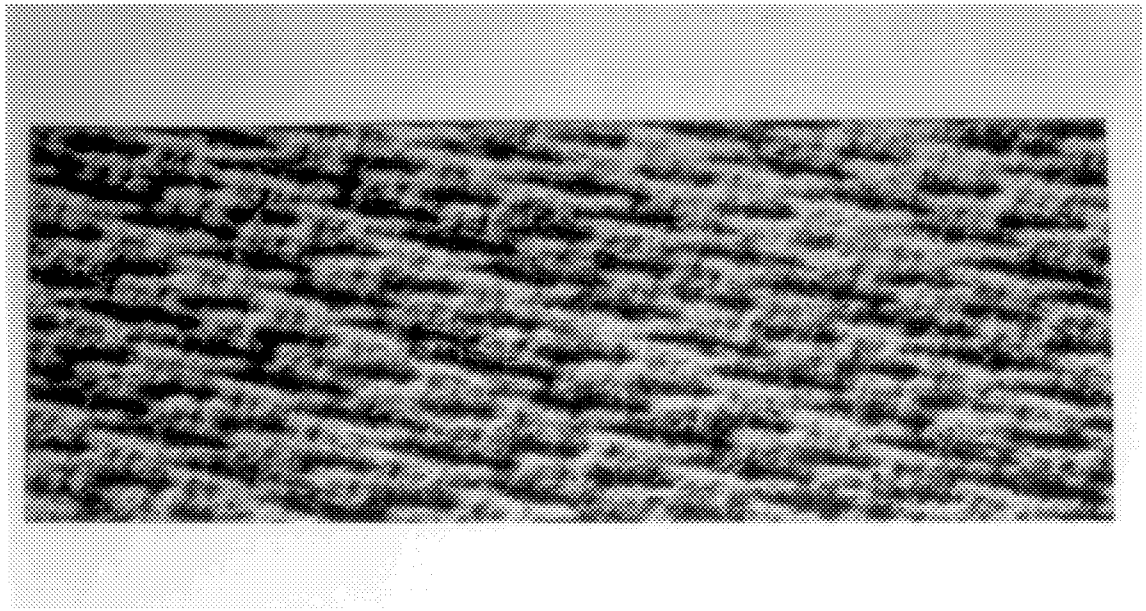
FIG. 13 is a photo of the fabric side of an uncreped produced with the fabric shown in FIG. 7.
Figure 14:
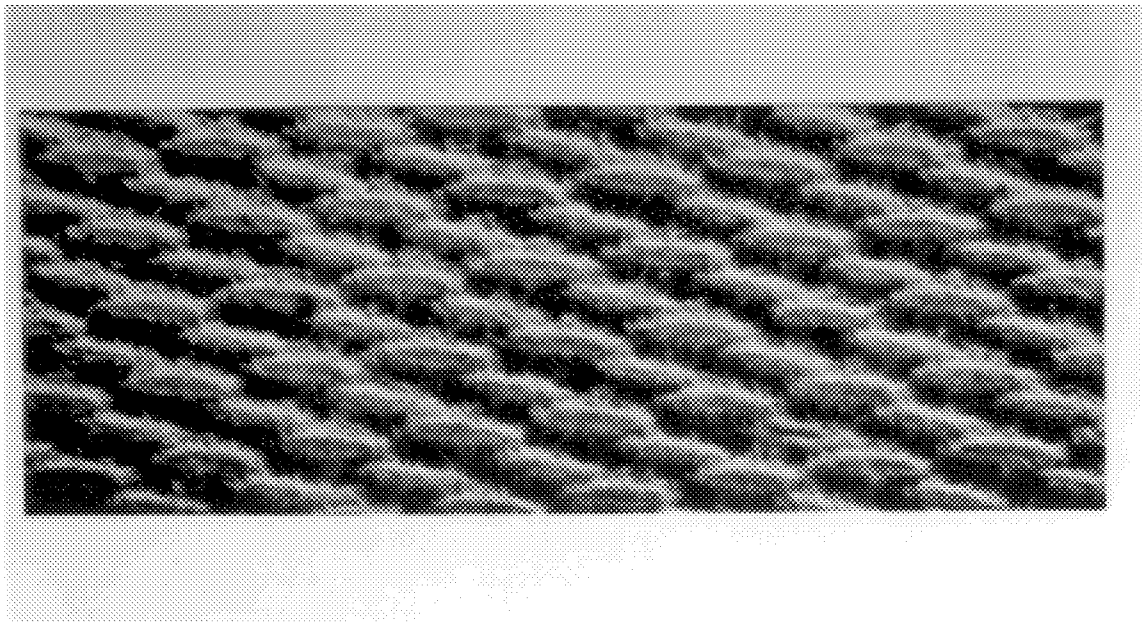
FIG. 14 is a photograph showing the opposite side, dryer side, of the uncreped web shown in FIG. 1.
Figure 15:
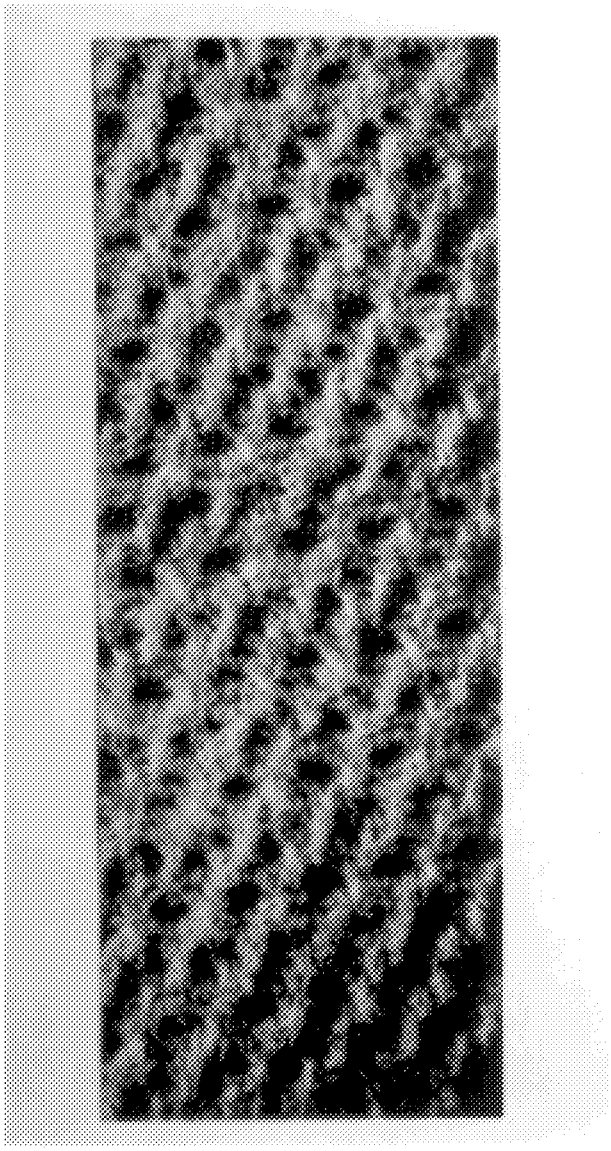
FIG. 15 is a photograph showing the opposite side, dryer side, of the creped web shown in FIG. 2.

FIG. 12 is a highly magnified photo of the fabric of FIG. 4 taken on a bias, specifically along the first axis as defined above. It clearly shows fabric channels which are below the top surface plane which have subsurface CD crossovers to help support the sheet. In some of the designs where the ridges are particularly wide or high, an occasional MD knuckle may also be incorporated to help stabilize the high bulk, continuous ridges. This gives the ridges the appearance of having craters, or of a chain link fence, or of connected bagels, as is shown in the photograph that is provided as FIG. 13. It should be noted that on the opposite, or "dryer side," of the soft absorbent sheet, the ridge areas appear as depressed channels of uncompressed fibers bounded by the same array of compressed fibers formed by the MD knuckles, (The "dryer side" is defined as the side of the sheet not facing or against the drying fabric, i.e. the side against a Yankee or can dryers; the side incident to the hot air in a TD or impingement dryer; and/or the side against a capillary surface in a capillary type dewatering system.) The "dryer side" of the sheet appears as the inverse of the "air side." FIGS. 14 and 15 show the dryer side of the uncreped and creped sheet corresponding to FIGS. 1 and 2. Again the array of compressed fiber formed by the MD knuckles and associated depressed channels are clearly visible.

Figure 16:
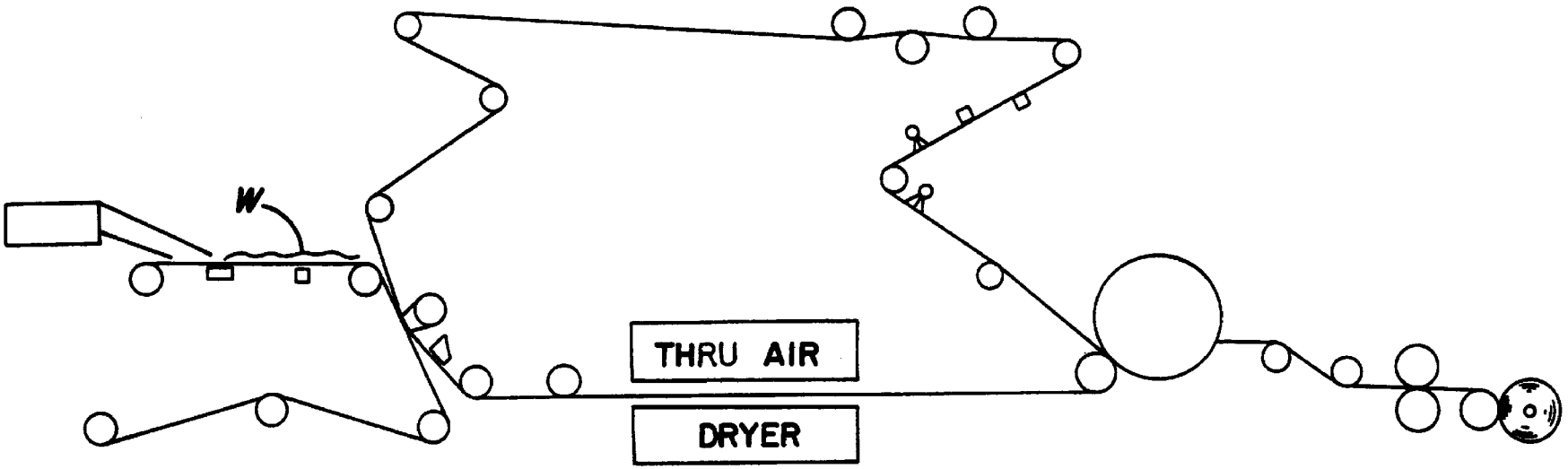
FIG. 16 is a schematic representation of a typical papermaking process that would employ fabrics made according to this invention.

The process for making the soft absorbent tissue described above was a through drying process of the type that is well known in this area of technology, as evidenced by Sanford U.S. Pat. No. 3,301,746 the disclosure of which is incorporated by reference as if set forth fully herein. Additional process schematics can be seen in FIG. 16. The process settings for this experiment are shown in Table 1. The stratified sheet was formed by a standard Valmet TWF consisting of an Outer Forming Fabric (OFF) and Inner Forming Fabric (IFF) of representative designs. The forming end of the PM is not believed to be critical to the invention; a SBR former or Fourdrinier could be used. The sheet was transferred at about 18–22% dry to a TD fabric having a complex woven design of the type described in this patent invention record. Some additional dewatering was done on the TD fabric before through-drying to about 85% dry. The sheet was drawn into the complex woven TD fabric by the action of the transfer and dewatering vacuums; in this way the continuous ridges of relatively uncompressed fiber were formed. The transfer of the sheet may occur with or without any relative speed difference between the IFF and TD fabrics. The side of the sheet against/in the TD fabric is referred to as the "air side," while that facing away from the TD fabric as the "dryer side". The sheet was then patterned pressed onto the Yankee where the drying was completed before subsequent creping, calendaring, and reeling up.

The dryness values noted above are typical in the industry. The IFF/TD fabric transfer could take place at 10%–35% dry while the transfer to the Yankee dryer could take place at 35%–95% dry.

The TD papermaking process described above is only one way in which the soft, absorbent tissue sheet could be made. The sheet drying could be completed by the TD's alone with no Yankee or creping step. The TD's could be replaced by all can dryers to remove the water and complete the drying. In fact, the forming, transfer systems, and complex woven fabrics noted previously could be used with numerous combinations of TD's, Yankee's, can dryers, and/or capillary dewatering units to complete the dewatering and drying of the sheet without overall compaction to produce the desired bulky, soft, absorbent tissue product.

To achieve the distinctive, soft creped tissue product of this invention, the complex woven drying fabric must be designed, woven, and heat set such that the fabric has only long warp knuckles in the top plane of the sheet side, and that these knuckles be in an array which bound, or define, subsurface channels running parallel to each other and at an angle to both the MD and CD. The top plane of the Sheet Side (SS) of the fabric would therefore look like FIG. 2, with the warp knuckles corresponding to the compressed areas in the sheet and the channels being the mechanism to create the paper ridges.

Tissue product of this invention has higher bulk, superior handfeel ("HF") and more cross-direction stretch ("CDS") than fabrics described by the prior art. The "granite weave" of Khan is a woven fabric manufactured by Albany International, which is considered to be an excellent fabric and is state of the art. The information provided in Tables 1 and 2 compare product made from four fabrics according to this invention with a 44×36 granite weave fabric and a finer 59×44 granite weave fabric having the same type of weave as the 44GST fabric. All fabrics were sanded to about the same level (20%–22%). All product was made on the same TD paper machine, FIG. 16, which is typical of those in common use throughout the industry. Furnish and papermaking conditions are given in Table 1. Paper property data is given in Table 2. Selected data represents actual points taken about the same level of strength as seen in the MD and CD tensile comparisons.

TABLE 1

| PROCESS SETTINGS | Trial Fabric # | | | | |
|---|---|---|---|---|---|
| | Prior Art | 1 | 2 | 3 | 4 |
| Overall Furnish (all trials) | 40% NSWK 30% SHWK 30% Eucalyptus | 40% NSWK 30% SHWK 30% Eucalyptus | 40% NSWK 30% SHWK 30% Eucalyptus | 40% NSWK 30% SHWK 30% Eucalyptus | 40% NSWK 30% SHWK 30% Eucalyptus |
| Reel Speed (mpm) | 1,000 | 1,000 | 1,000 | 1,000 | 1,000 |
| Crepe Dryness(%) | 98.2 | 99.8 | 99.1 | 99.3 | 97.4 |
| TD Hood Suppy Temp (°F.) | 475 | 468 | 477 | 465 | 481 |
| TD Gas Flaw (SCFH) | 9.967 | 9.503 | 9.812 | 8.986 | 9.168 |
| TD Cleaning Water (PPM) | 330 | 168 | 202 | 123 | 420 |

TABLE 2

| PAPER PROPERTIES | Trial Fabric | | | | |
|---|---|---|---|---|---|
| | Prior Art | 1 | 2 | 3 | 4 |
| Basic Wgt (gsm) | 24.5 | 24.9 | 25.5 | 25.1 | 25.2 |
| Uncal Bulk (1.0 KPA, $^{mm}$/10 Plys) | 3.34 | 3.66 | 3.84 | 3.60 | 4.75 |
| Bulk/BW ($^{cc}$/gr) | 13.6 | 14.7 | 15.1 | 14.3 | 18.7 |
| MDT (gr/in) | 318 | 399 | 363 | 352 | 322 |
| CDT (gr/in) | 189 | 218 | 193 | 216 | 175 |
| MD Stretch (%) | 17.0 | 20.4 | 18.6 | 18.8 | 19.0 |
| CD Stretch (%) | 6.6 | 8.5 | 8.7 | 7.6 | 11.2 |
| Apparent Density ($^{1}$/B/BW) ($^{gr}$/cc) | 0.0734 | 0.0680 | 0.0662 | 0.0699 | 0.0536 |
| Handfeel* | 1.00 | 1.05 | 1.20 | 1.15 | 1.05 |

*Normalized to prior art (=1.0)

The uncreped bulk was 15 to 25% higher than that of the control product. The creped sheet uncalendered bulk increased from 8 to 42% versus the control. Average softness ratings were up 5 to 20% versus the control. Calendared MD stretch was up from 9 to 20% and CD stretch was up 15 to 70% versus the control. The calendered CD stretch for one of the fabrics made from this invention was 11.2% (absolute value) which is uniquely high for this TD papermaking process. The increases in bulk, TWA, HF, and stretch are all desirable characteristics for sanitary products—tissue, towel, napkins, etc.

All fabrics ran well in terms of sheet release at the pressure roll. The amount of fiber washed out of the fabric at the cleaning section (TD PPM's) was very low on three out of the four fabrics, and well below the control. The amount of fiber washed out of the fabric is inversely proportional to ease of release (high values represent more fiber carry back and, therefore, poorer release). This also suggests that the fabrics ran cleaner that the control which should improve fabric life. The experimental fabrics dried better than the control. In most cases the average TD supply temperatures were at or below the control, with while the average sheet dryness post TD was about the same. Average gas flow was less for all fabrics of this invention. An additional benefit from fabrics of this invention is that the LWK's with greater overlap improves efficiency of the creping process. Additionally, the higher uncalendered bulks suggest that the experimental fabrics could be sanded more or the mesh count increased to take advantage of this gain. Since there is a large out-of-plane difference between the top surface plane warp knuckles and the sub surface shute knuckles on these fabrics, increased sanding could be done while maintaining all specs of invention and still getting good prod quality. This would help adhesion and creping at high PM speeds on light weight tissue. For example, at 30% sanded area, sheet tension increase by 20% at constant paper strength over a control run using a prior art granite weave TD fabric having the identical sanded area.

In its application as a forming fabric the complex woven designs of this invention may be used in all types of papermaking processes (sanitary tissue, flat paper grades, liner board, etc.). The particular weave, mesh count, shed, and yarn size may vary by application, but will all fall under the limitations imposed by the invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An improved drying fabric having a sheet side for supporting and imparting texture to a fiber web during drying in a process for manufacturing an absorbent paper product, comprising:

a plurality of shute threads extending substantially parallel to each other in a cross-direction of the drying fabric; and a plurality of warp threads extending substantially parallel to each other in a machine direction of the drying fabric, said shute and warp threads being woven together so as to define a top surface plane on the sheet side containing only a number of relatively long warp knuckles at locations where one of said warp threads crosses over at least four of said shute threads, said long warp knuckles being positioned in a shed pattern so as to form (a) a first axis of bulky ridges that are defined by the long warp knuckles which are positioned next to each other on adjacent warp threads, said first axis being disposed at a first angle with respect to the cross-direction of the drying fabric, said first angle being substantially within the range of greater than 68 degrees but less than 90 degrees; and (b) a second axis formed by each of said long warp knuckles with other, overlapping long warp knuckles on nearby warp threads, said second axis forming a second angle with respect to the cross direction of the drying fabric, said second angle being less than about 23 degrees, whereby the fabric will be configured to impart improved physical, sensory, aesthetic and crepeability characteristics to an absorbent web that is formed, transferred, or dried thereon.

2. An improved drying fabric according to claim 1, wherein each long warp knuckle overlaps adjacent long warp knuckles in said second axis by at least 60 percent.

3. An improved drying fabric according to claim 1, wherein each long warp knuckle overlaps, in the machine direction, adjacent long warp knuckles along said second axis by at least 0.035 inches.

4. An improved fabric according to claim 1, wherein said warp and shute threads are woven in a shed count that is at least nine.

5. An improved fabric according to claim 4, wherein said warp and shute threads are woven in a shed count of at least thirteen.

6. An improved fabric according to claim 5, wherein said thirteen shed fabric has a warp pattern of five over, two under, four over and two under.

7. An improved fabric according to claim 1, wherein said long warp knuckles are sanded so as to reside in a common plane that is elevated with respect to said shute threads and knuckles of said shute threads.

8. An improved fabric according to claim 1, wherein said warp and shute threads are woven so as to create lateral crimp.

9. An improved fabric according to claim 1, wherein said warp and shute threads are woven with a fabric break that is greater than one.

10. An improved fabric according to claim 9, wherein said warp and shute threads are woven in a mesh count that is between 10×10 to 120×120.

11. An improved drying fabric having a sheet side for supporting and imparting texture to a fiber web during forming, transferring, and/or drying in a process for manufacturing an absorbent paper product such as toilet tissue, towel, printing paper, liner board, flat grades paper, or the like, comprising:

a plurality of shute threads extending substantially parallel to each other in a cross-direction of the drying fabric; and a plurality of round warp threads extending substantially parallel to each other in a machine direction of the drying fabric, said shute and warp threads being woven together so as to define a top surface plane on the sheet side containing only a number of relatively long warp knuckles at locations where one of said warp threads crosses over at least four of said shute threads, said long warp knuckles being positioned in a shed pattern so as to form (a) a first axis of bulky ridges that are defined by the long warp knuckles which are positioned next to each other on adjacent warp threads, said first axis being disposed at a first angle with respect to the cross-direction of the drying fabric; and (b) a second axis formed by each of said long warp knuckles with other, overlapping long warp knuckles on nearby warp threads, wherein said overlapping knuckles in said second axis overlap by at least 0.035 inches, whereby the fabric will be configured to impart improved physical, sensory, aesthetic, and/or crepeability characteristics to an absorbent web that is formed, transferred, or dried thereon.

12. An improved drying fabric according to claim 11, wherein each long warp knuckle overlaps adjacent long warp knuckles in said second axis by at least 60 percent.

13. An improved drying fabric according to claim 11, wherein said long warp knuckles reside in a plane that is elevated with respect to any cross-direction knuckles on the fabric by at least 0.004" inches.

14. An improved fabric according to claim 11, wherein said warp and shute threads are woven in a shed count that is at least nine.

15. An improved fabric according to claim 14, wherein said warp and shute threads are woven in a shed count of at least thirteen.

16. An improved fabric according to claim 15, wherein said thirteen shed fabric has a warp pattern of five over, two under, four over and two under.

17. An improved fabric according to claim 11, wherein said long warp knuckles are sanded so as to reside in a common plane that is elevated with respect to said shute threads and knuckles of said shute threads.

18. An improved fabric according to claim 11, wherein said warp and shute threads are woven so as to create lateral crimp.

19. An improved fabric according to claim 11, wherein said warp and shute threads are woven with a fabric break that is greater than one.

20. An improved fabric according to claim 19, wherein said warp and shute threads are woven in a mesh count that is between 10×10 to 120×120.

21. An improved drying fabric for supporting and imparting texture to a fiber web during forming, transferring, and/or drying in a process for manufacturing an absorbent paper product such as toilet tissue, towel, printing papers, liner board, flat grades, etc., comprising:

a plurality of shute threads extending substantially parallel to each other in a cross-direction of the drying fabric; and a plurality of warp threads extending substantially parallel to each other in a machine direction of the drying fabric, said shute and warp threads being woven together in a shed count that is at least nine so as to define a number of relatively long warp knuckles at locations where one of said warp threads crosses over at least four of said shute threads, said long warp knuckles being positioned so as to form (a) a first axis of bulky ridges that are defined by the long warp knuckles which are positioned next to each other on adjacent warp threads, said first axis being disposed at a first angle with respect to the cross-direction of the drying fabric, said first angle being substantially within the range of greater than 68 degrees but less than 90 degrees; and (b) a second axis formed by each of said long warp knuckles with other, overlapping long warp knuckles on nearby warp threads, said second axis forming a second angle with respect to the cross-direction of the drying fabric, said second angle being less than about 28 degrees, and wherein said overlapping knuckles in said second axis overlap by at least 0.035 inches and 60 percent, whereby the fabric will be configured to impart improved sensory, aesthetic and crepeability characteristics to an absorbent paper web that is dried thereon.

22. An improved drying fabric according to claim 21, wherein said long warp knuckles reside in a plane that is elevated with respect to any cross-direction knuckles on the fabric by at least 0.004" inches.

23. An improved fabric according to claim 21, wherein said warp and shute threads are woven in a shed count of at least thirteen.

24. An improved fabric according to claim 23, wherein said thirteen shed fabric has a warp pattern of five over, two under, four over and two under.

25. An improved fabric according to claim 21, herein said long warp knuckles are sanded so as to reside in a common plane that is elevated with respect to said shute threads and knuckles of said shute threads.

26. An improved fabric according to claim 21, wherein said warp and shute threads are woven so as to create lateral crimp.

27. An improved fabric according to claim 21, wherein said warp and shute threads are woven with a fabric break that is greater than one.

28. An improved fabric according to claim 27, wherein said warp and shute counts are between 10×10 to 120×120.

29. An improved drying fabric in combination with a dried absorbent paper web, said fabric having a sheet side for supporting and imparting texture to a fiber web during drying in a process for manufacturing an absorbent paper product, said fabric comprising a plurality of shute threads extending substantially parallel to each other in a cross-direction of the drying fabric; and a plurality of warp threads extending substantially parallel to each other in a machine direction of the drying fabric, said shute and warp threads being woven together so as to define a top surface plane on the sheet side containing only a number of relatively long warp knuckles at locations where one of said warp threads crosses over at least four of said shute threads, said long warp knuckles being positioned in a shed pattern so as to form (a) a first axis of bulky ridges that are defined by the long warp knuckles which are positioned next to each other on adjacent warp threads, said first axis being disposed at a first angle with respect to the cross-direction of the drying fabric, said first angle being substantially within the range of greater than 68 degrees but less than 90 degrees; and (b) a second axis formed by each of said long warp knuckles with other, overlapping long warp knuckles on nearby warp threads, said second axis forming a second angle with respect to the cross direction of the drying fabric, said second angle being less than about 28 degrees.

30. An improved drying fabric in combination with a dried absorbent paper web, said fabric having a sheet side for supporting and imparting texture to a fiber web during forming, transferring, and/or drying in a process for manufacturing an absorbent paper web such as toilet tissue, towel, printing paper, liner board, flat grades paper, or the like, said fabric comprising a plurality of shute threads extending substantially parallel to each other in a cross-direction of the drying fabric; and a plurality of warp threads extending substantially parallel to each other in a machine direction of the drying fabric, said shute and warp threads being woven together so as to define a top surface plane on the sheet side containing only a number of relatively long warp knuckles at locations where one of said warp threads crosses over at least four of said shute threads, said long warp knuckles being positioned in a shed pattern so as to form (a) a first axis of bulky ridges that are defined by the long warp knuckles which are positioned next to each other on adjacent warp threads, said first axis being disposed at a first angle with respect to the cross-direction of the drying fabric; and (b) a second axis formed by each of said long warp knuckles with other, overlapping long warp knuckles on nearby warp threads, wherein said overlapping knuckles in said second axis overlap by at least 0.035 inches.

31. An improved drying fabric in combination with a dried absorbent paper web, said fabric comprising: a plurality of shute threads extending substantially parallel to each other in a cross-direction of the drying fabric; and a plurality of warp threads extending substantially parallel to each other in a machine direction of the drying fabric, said shute and warp threads being woven together in a shed count that is at least nine so as to define a number of relatively long warp knuckles at locations where one of said warp threads crosses over at least four of said shute threads, said long warp knuckles being positioned so as to form (a) a first axis of bulky ridges that are defined by the long warp knuckles which are positioned next to each other on adjacent warp threads, said first axis being disposed at a first angle with respect to the cross-direction of the drying fabric, said first angle being substantially within the range of greater than 68 degrees but less than 90 degrees; and (b) a second axis formed by each of said long warp knuckles with other, overlapping long warp knuckles on nearby warp threads, said second axis forming a second angle with respect to the cross-direction of the drying fabric, said second angle being less than about 28 degrees, and wherein said overlapping knuckles in said second axis overlap by at least 0.035 inches and 60 percent.

* * * * *

UNITED STATES PATENT AND TRADEMARK OFFICE

CERTIFICATE OF CORRECTION

PATENT NO. : 5,832,962

DATED : Nov. 10, 1998

INVENTOR(S) : Kenneth Kaufman; Jeff Herman

It is certified that error appears in the above-identified patent and that said Letters Patent is hereby corrected as shown below:

Col. 13, line 31, delete "23" and insert --28-- therefore.

Signed and Sealed this

Eighth Day of February, 2000

*Attest:*

*Attesting Officer*

Q. TODD DICKINSON

*Commissioner of Patents and Trademarks*